US009279646B1

(12) United States Patent
Crispell et al.

(10) Patent No.: US 9,279,646 B1
(45) Date of Patent: Mar. 8, 2016

(54) TOY ARROW WHISTLE

(71) Applicants: Suzanne Crispell, Miami, FL (US); XiaoMing Fu, zhenhai NinBo ZheJiang Province (CN)

(72) Inventors: Suzanne Crispell, Miami, FL (US); XiaoMing Fu, zhenhai NinBo ZheJiang Province (CN)

( * ) Notice: Subject to any disclaimer, the term of this patent is extended or adjusted under 35 U.S.C. 154(b) by 0 days.

(21) Appl. No.: 14/493,324

(22) Filed: Sep. 22, 2014

(51) Int. Cl.

| | |
|---|---|
| ***F42B 6/04*** | (2006.01) |
| ***A63H 5/00*** | (2006.01) |
| ***F42B 6/02*** | (2006.01) |
| ***F42B 12/36*** | (2006.01) |

(52) U.S. Cl.
CPC .. *F42B 6/02* (2013.01); *A63H 5/00* (2013.01); *F42B 6/04* (2013.01); *F42B 12/362* (2013.01)

(58) Field of Classification Search
CPC ..... A63H 5/00; A63H 33/18; F42B 6/003; F42B 6/02; F42B 6/04; F42B 6/08
See application file for complete search history.

(56) References Cited

U.S. PATENT DOCUMENTS

| | | | | | |
|---|---|---|---|---|---|
| 2,443,395 | A * | 6/1948 | Lutins | 473/571 |
| 2,621,441 | A * | 12/1952 | Worden | 446/34 |
| 2,836,930 | A * | 6/1958 | Ragazzo et al. | 446/213 |
| 2,838,871 | A * | 6/1958 | Boring | 446/216 |
| 3,418,995 | A * | 12/1968 | Heller | 124/27 |
| 4,030,761 | A * | 6/1977 | Daller | 473/572 |
| 4,203,252 | A * | 5/1980 | Howie | 446/216 |
| 5,746,640 | A * | 5/1998 | Meadows | 446/213 |
| 6,083,127 | A * | 7/2000 | O'Shea | 473/571 |
| 2014/0000577 | A1 * | 1/2014 | Cummings | 124/20.1 |

* cited by examiner

*Primary Examiner* — John Ricci

(57) ABSTRACT

A noise making arrow is provided. The noise making arrow includes an arrow body having a head and a tail. A whistle is attached to the arrow body. The whistle may include a slot that is positioned in the same direction as the head of the arrow body. When the arrow is launched, air may rush through the slot and exit the slot, creating a whistle noise.

10 Claims, 4 Drawing Sheets

TOY ARROW WHISTLE

BACKGROUND OF THE INVENTION

The present invention relates to a toy arrow and, more particularly, to a whistle attached to the tow arrow.

Toy arrows are typically launched into the sky by a rubber sling shot. Currently, toy arrows may include lights, such as light emitting diodes (LEDs), to add to the experience. While lights may add to the visual effect, the toy arrows currently lack any audio affect.

As can be seen, there is a need for a whistle attached to tow arrows.

SUMMARY OF THE INVENTION

In one aspect of the present invention, a noise making arrow comprises: an arrow body comprising a head and a tail; and a whistle attached to the arrow body, wherein the whistle comprises: a sidewall forming an internal cavity, wherein the sidewall comprises a top portion, a bottom portion, a front portion, a rear portion, a first side portion, and a second side portion, wherein the top portion is facing a same direction as the head of the arrow body, wherein a slot is formed through the sidewall near the top portion and is positioned so that air travels through the slot, around the internal cavity and out of the slot while traveling through the air, thereby creating a whistle noise.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes an arrow with plastic wings that whistles when launched into the air. The arrow may be launched using a plastic stick and rubber band launcher. The present invention may include LED lights and may resemble fireworks. Air rushes through a slot through the whistle in a way that creates the whistling noise. The whistle may be made by an injection machine and sealed by hand.

Figure 1:
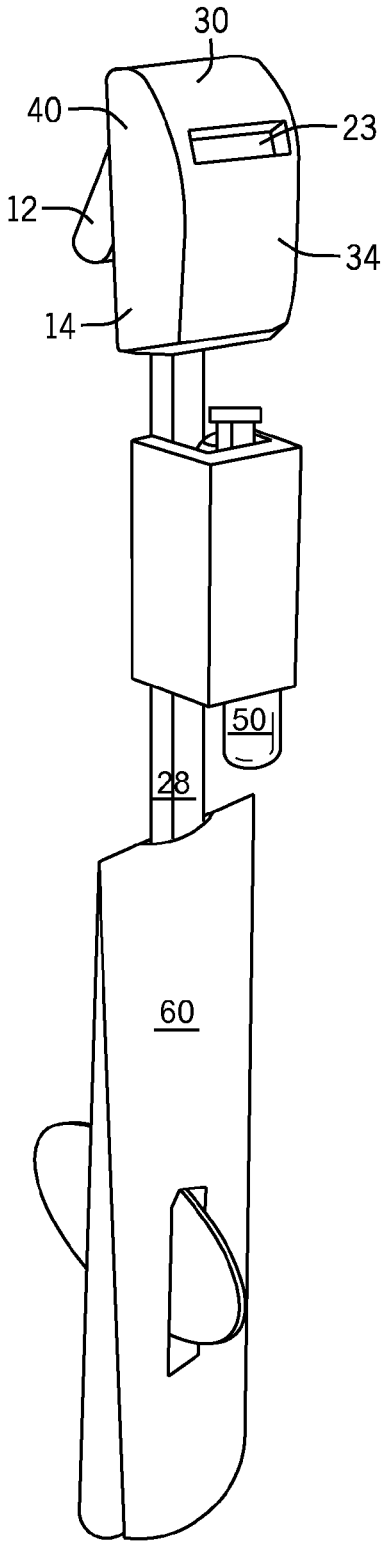
FIG. 1 is a perspective view of an embodiment of the present invention.
Figure 2:
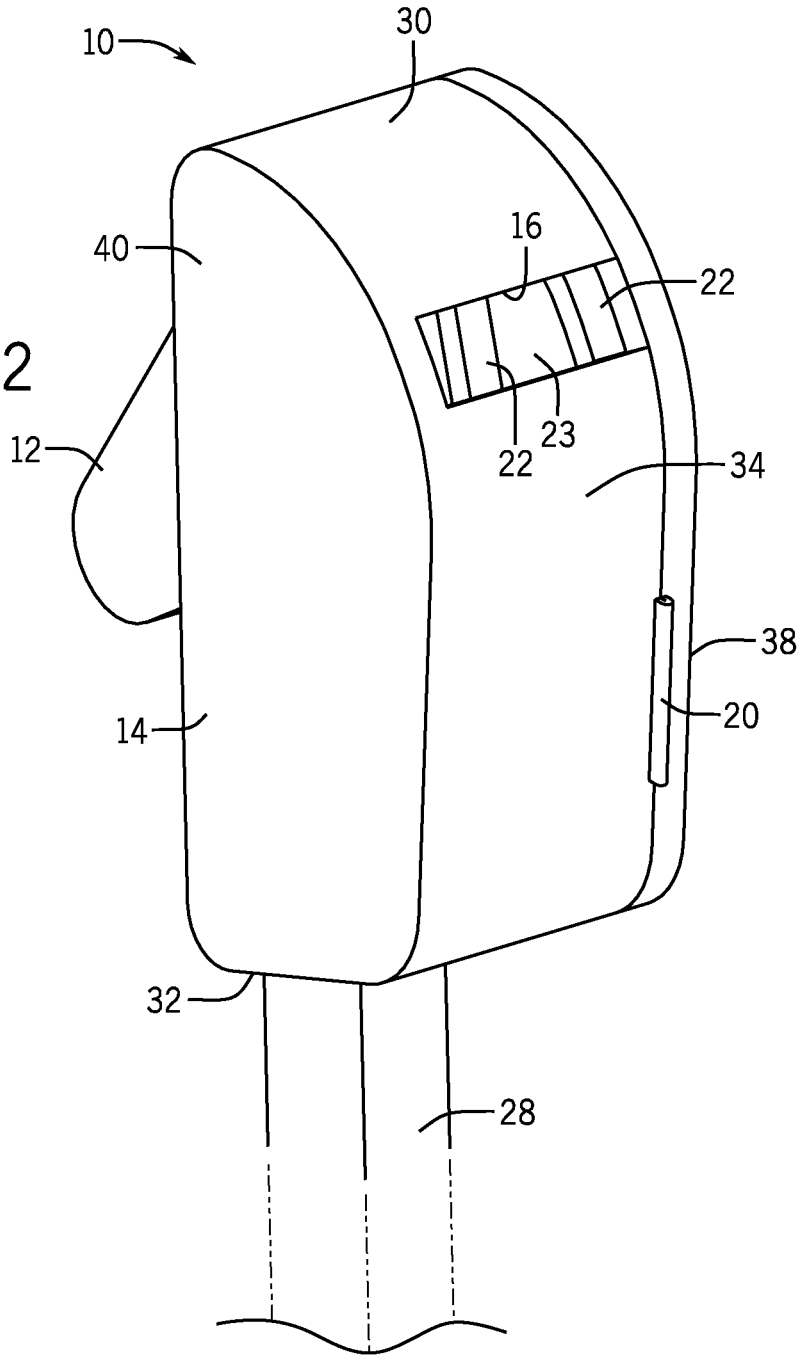
FIG. 2 is a detail perspective view of the whistle of the present invention.
Figure 4:
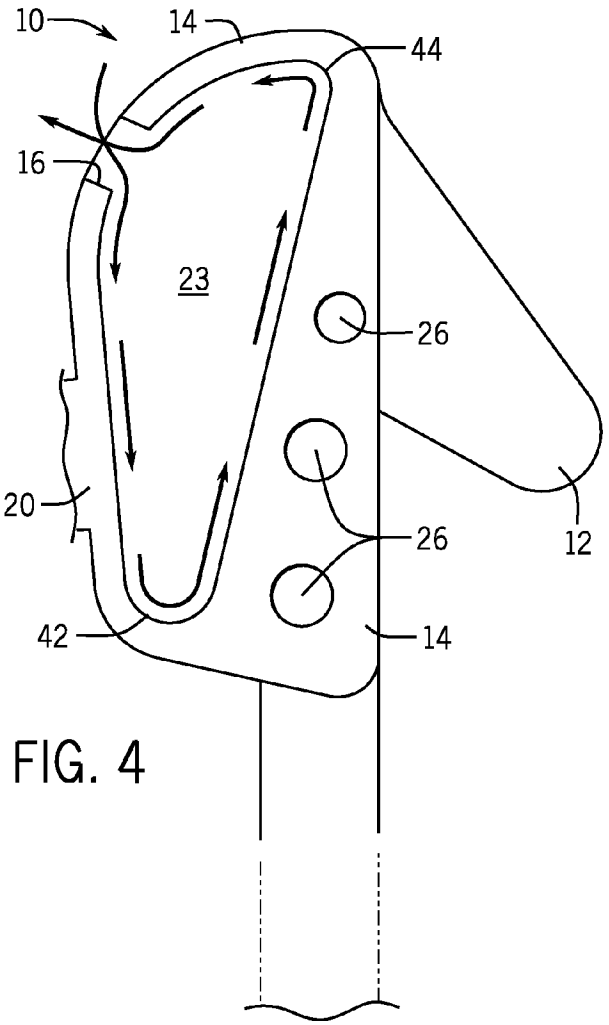
FIG. 4 is a side elevation view of the present invention with the first side portion broken away.
Figure 3:
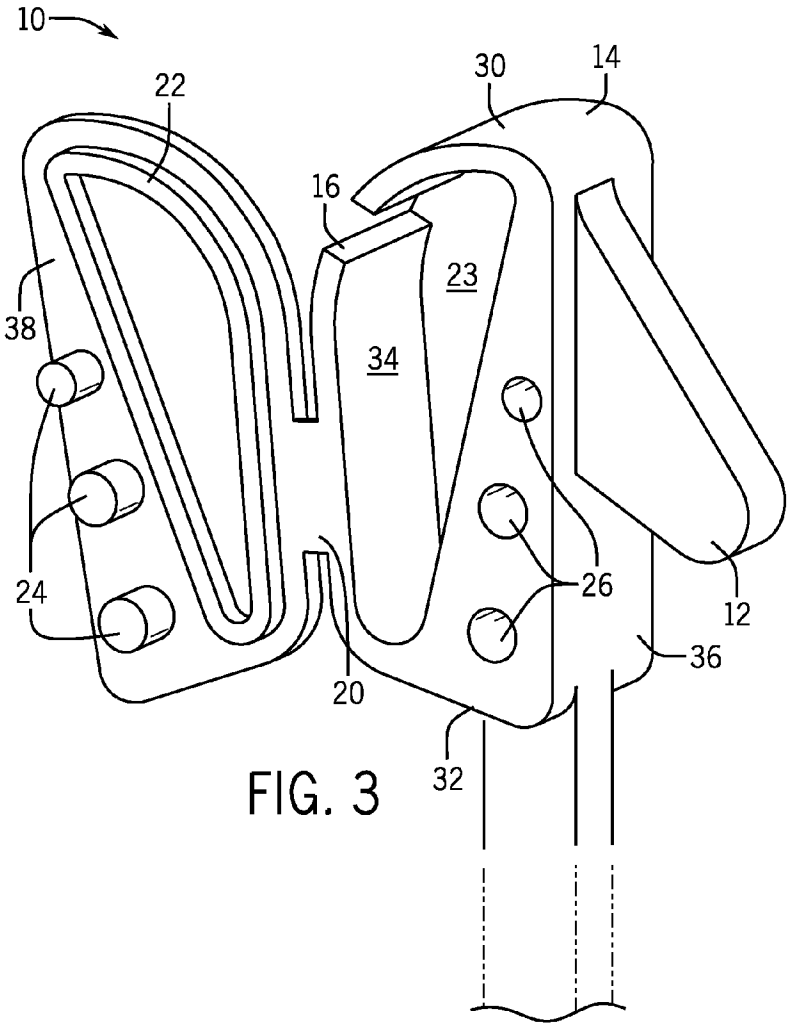
FIG. 3 is a perspective view of the present invention with the first side portion in an open position.
Figure 5:
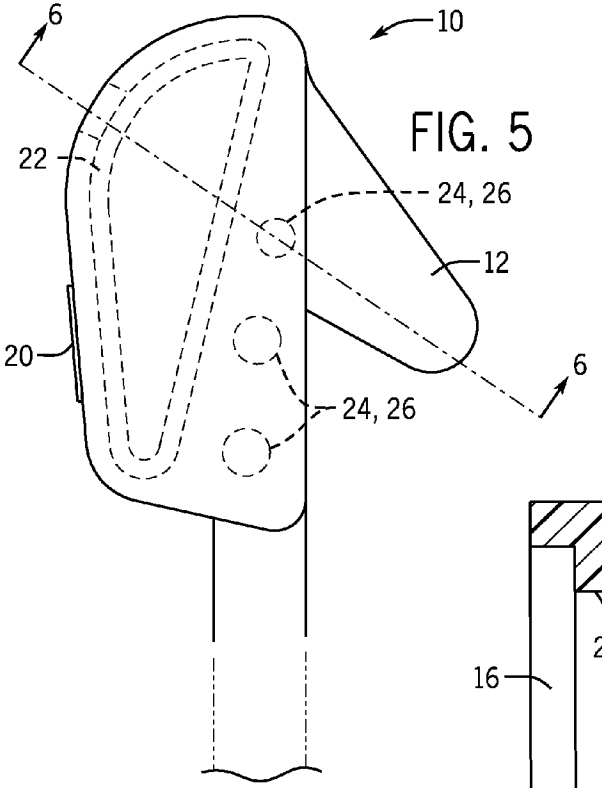
FIG. 5 is a side elevation view of an embodiment of the present invention.
Figure 6:
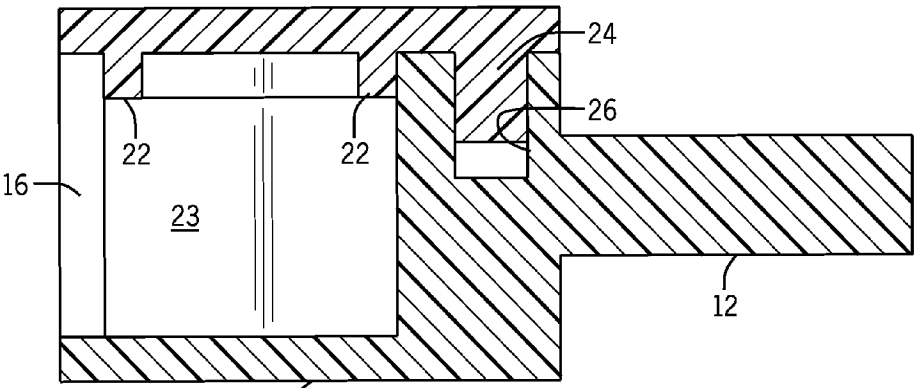
FIG. 6 is a cross-sectional view taken along line 6-6 of FIG. 5.

Referring to FIGS. 1 through 5, the present invention includes a noise making arrow 10. The noise making arrow 10 includes an arrow body 28 having a head and a tail. The noise making arrow 10 may include a light element 50 and a copter element 60. The noise making arrow 10 further includes a whistle 14. The whistle 14 of the present invention includes a sidewall having a top portion 30, a bottom portion 32, a front portion 34, a rear portion 36, a first side portion 38, and a second side portion 40. The top portion 30 may be facing the same direction as the head of the arrow body 28.

A slot 16 may be formed through the sidewall of the whistle 14. The slot 16 may be oriented near the top portion 30 and is positioned so that air travels through the slot 16, around the internal cavity 23 and out of the slot 16 while traveling through the air. When the arrow is launched, the air traveling through the slot 16 and internal cavity 23 creates a whistle noise. In certain embodiments, the slot 16 may be positioned in between the top portion 30 and the front portion 34. The top portion 30 may curve into the slot 16 and may thereby curve towards the front portion 34.

The internal cavity 23 of the present invention includes an internal wall. The internal wall may include two directional changes 42, 44. The two directional changes 42, 44 may include a first rounded bend 42 and a second rounded bend 42. The first rounded bend 42 may be formed on the internal wall near the bottom portion 32. The second rounded bend 44 may be formed on the internal wall near the top portion 30. When the air travels into the slot 16 the air is directed to the first rounded bend 42. The first rounded bend 42 then directs the air to the second rounded bend 44, and the second rounded bend 44 directs the air back out of the slot 16, creating the whistle noise.

In certain embodiments, the present invention may include a hook 12. The hook 12 may be used to launch the arrow 10 into the air using a rubber sling shot. The hook 12 of the present invention may extend from the rear portion 36 of the sidewall. The hook 12 may be slanted at an angle towards the bottom portion 32. In certain embodiments, the whistle 14 of the present invention may be the head of the arrow 10. Therefore, the user may hook the whistle 14 to the slingshot and launch the whistle 14 with the top portion 30 faced forwards.

The dimensions of the components of the present invention may include the following. The slot 16 of the present invention may be about 14 cm in width and about 3 cm in height. For example, the slot 16 may be about 10.6 cm in width and about 3 cm in height. The top portion 30 may be about 6 cm in length and about 11 cm in width. For example, the top portion 30 may be about 6.2 cm in length and about 10.6 cm in width. A distance between the first rounded bend 42 and the second rounded bend 44 may be about 19 cm. For example, the distance between the first rounded bend 42 and the second rounded bend 44 may be about 18.8 cm. The dimensions and positioning of the components of the whistle allow for the present invention to work.

In certain embodiments, the noise making arrow 10 may be manufactured as one piece by a molding process. As illustrated in the Figures, the noise making arrow 10 may be molded with the first side portion 38 connected to the sidewall by a hinge 20. The inner surface of the first side portion 38 may include a continuous ridge 22 that may align with the internal cavity 23. The inner surface of the first side portion 38 may further include a plurality of bosses 24. A plurality of apertures 26 may be formed in the sidewall. The bosses 24 may mate with the apertures 26 and thereby lock the first side portion 38 closed. Further, the first side portion 38 may be glued to the remainder of the sidewall.

It should be understood, of course, that the foregoing relates to exemplary embodiments of the invention and that modifications may be made without departing from the spirit and scope of the invention as set forth in the following claims.

What is claimed is:

1. A noise making arrow comprising:

an arrow body comprising a head and a tail; and a whistle attached to the arrow body, wherein the whistle comprises:

a sidewall forming an internal cavity, wherein the sidewall comprises a top portion, a bottom portion, a front portion, a rear portion, a first side portion, and a second side portion, wherein the top portion is facing a same direction as the head of the arrow body, wherein the internal cavity comprises an internal wall, wherein the internal wall comprises two directional changes, wherein a slot is formed through the sidewall near the top portion and is positioned so that air travels through the slot, around the internal cavity and out of the slot while traveling through the air, thereby creating a whistle noise.

2. The noise making arrow of claim 1, wherein the slot is formed through the sidewall in between the top portion and the front portion.

3. The noise making arrow of claim 2, wherein the top portion is curved towards the front portion.

4. The noise making arrow of claim 1, wherein the two directional changes comprises a first rounded bend near the bottom portion and a second rounded bend near the top portion, wherein the air travels into the slot and is directed to the first rounded bend, the first rounded bend directs the air to the second rounded bend, and the second rounded bend directs the air back out of the slot.

5. The noise making arrow of claim 1, wherein the whistle is the head of the arrow.

6. The noise making arrow of claim 1, further comprising a hook extending from the rear portion.

7. The noise making arrow of claim 6, wherein the hook is slanted at an angle towards the bottom portion.

8. The noise making arrow of claim 1, wherein the first side portion is attached to the sidewall by a hinge.

9. The noise making arrow of claim 8, wherein the first side portion comprises a plurality of bosses that fit within a plurality of apertures of the sidewall.

10. A noise making arrow comprising:

an arrow body comprising a head and a tail; and a whistle attached to the arrow body, wherein the whistle comprises:

a sidewall forming an internal cavity, wherein the sidewall comprises a top portion, a bottom portion, a front portion, a rear portion, a first side portion, and a second side portion, wherein the top portion is facing a same direction as the head of the arrow body, wherein the first side portion is attached to the sidewall by a hinge, wherein a slot is formed through the sidewall near the top portion and is positioned so that air travels through the slot, around the internal cavity and out of the slot while traveling through the air, thereby creating a whistle noise.

* * * * *